US006164859A

United States Patent [19]

Hambright

[11] Patent Number: 6,164,859

[45] Date of Patent: Dec. 26, 2000

[54] FOLDING ALBUM PAGE

[76] Inventor: Perry N. Hambright, 2112 Eastman Ave., Suite 106, Ventura, Calif. 93003

[21] Appl. No.: 09/312,607

[22] Filed: May 17, 1999

[51] Int. Cl.[7] ..... B42F 13/00

[52] U.S. Cl. ..... 402/73; 281/38; 402/79; 402/80 R

[58] Field of Search ..... 281/38; 402/73, 402/79, 80 R

[56] References Cited

U.S. PATENT DOCUMENTS

| | | | |
|---|---|---|---|
| 1,094,923 | 4/1914 | Palmer . | |
| 3,797,152 | 3/1974 | Brandt | 402/79 |
| 4,447,973 | 5/1984 | Wihlke | 40/159 |
| 4,516,871 | 5/1985 | Leitman . | |
| 4,704,042 | 11/1987 | Eisen et al. . | |
| 4,824,273 | 4/1989 | Silva et al. . | |
| 5,431,449 | 7/1995 | Arimoto et al. | 402/79 |
| 5,490,739 | 2/1996 | Olson | 281/38 |
| 5,722,694 | 3/1998 | Baldursson . | |
| 6,004,061 | 12/1999 | Manico et al. | 402/79 |

FOREIGN PATENT DOCUMENTS 2248693 10/1973 France .

*Primary Examiner*—A. L. Wellington
*Assistant Examiner*—Monica S. Carter
*Attorney, Agent, or Firm*—Roylance, Abrams, Berdo & Goodman, L.L.P.

[57] ABSTRACT

A folding album page for use in a binder with additional, similar album pages. The album page being formed of transparent material and having at least two pocket sections, which are folded relative to each other between a closed position and an open, panoramic display position. In the closed position, the album page can be stored in the binder. In the open position, the album page provides a panoramic display of articles placed within the pockets, especially when used in conjunction with other, adjacent album pages. A hinge connects the multiple pocket sections and permits the sections to be easily folded relative to each other in a range of approximately 360 degrees.

26 Claims, 5 Drawing Sheets

FOLDING ALBUM PAGE

FIELD OF THE INVENTION

The invention relates generally to a folding album page for insertion into a binder. More specifically, the invention relates to a transparent folding album page, which has at least two similarly shaped, top-opening pockets. The invention also relates to forming a folding album page from three sheets of transparent material.

BACKGROUND OF THE INVENTION

Album pages with pockets are generally formed as a single sheet, which is slightly smaller than the size of the album in which the page is attached. Thus, when the album is open, only one sheet or two separate, adjacent sheets can be simultaneously viewed.

Some album pages have an additional section, which folds relative to a main section. However, this additional section does not provide a panoramic display for the viewer. Additionally, the connection between the folded sections is often stiff and does not easily permit the sections to be positioned in a plurality or orientations Examples of prior art album pages are disclosed in the following U.S. Pat. Nos.: 1,094,923 to Palmer; 4,447,973 to Wihlke; 4,516,871 to Leitman; 4,704,042 to Eisen et al.; 4,824,273 to Silva et al.; and 5,722,694 to Baldursson.

Thus, there is a continuing need to provide an album page that provides a panoramic display and that has multiple sections that are easily positionable in many orientations. This invention addresses these needs in the art as well as other needs, which will become apparent to those skilled in the art once given this disclosure.

SUMMARY OF THE INVENTION

One object of the present invention is to provide a folding album page with multiple pockets.

Another object of the invention is to provide an album page that allows for a panoramic display of articles, such as photos.

Yet another object of the invention is to provide an album page that has at least two substantially identical pockets, which can be folded between a stored position and a panoramic position.

A further object of the invention is to provide a folding album page, which can be used together with other similar folding album pages to provide an extended panoramic display.

Still a further object of the invention is to provide a hinge between folded sections of an album page, which permits a folded section to be easily positioned through an approximately 360 degree range of pivoting.

The foregoing objects are basically attained by providing an album page comprising a first member having a first perimeter and a first pocket within the first perimeter, the first pocket being formed by first and second sheets, the first and second sheets being coupled together along a first closed portion of the first perimeter and the first and second sheets being uncoupled along a first open portion of the first perimeter, the first open portion allowing insertion of an article into the first pocket in a first direction, and the first closed portion prohibiting insertion of the article in the first pocket in any direction transverse to the first direction or opposite to the first direction; a second member having a second perimeter and a second pocket within the second perimeter, the second pocket being formed by third and fourth sheets, the third and fourth sheets being coupled together along a second closed portion of the second perimeter and the third and fourth sheets being uncoupled along a second open portion of the second perimeter, the second open portion allowing insertion of an article into the second pocket in a second direction which is substantially parallel to the first direction, and the second closed portion prohibiting insertion of the article in the second pocket in any direction transverse to the second direction or opposite to the second direction; a hinge coupled to both the first and second members and positioned between the first and second members, permitting the album page to be folded so that the first and second members can overlap each other; and a binder attaching element coupled to the first member and having at least one fastening portion.

The foregoing objects are also attained by providing an album page comprising a first sheet having a longitudinal axis, a hinge area extending substantially perpendicularly to the longitudinal axis, a binder attaching element extending substantially perpendicularly to the longitudinal axis at a first end of the sheet, and a second, free end extending substantially perpendicularly to the longitudinal axis; a second sheet coupled to and overlapping the first sheet and positioned between the binder attaching element and the hinge area; a third sheet coupled to and overlapping the first sheet and positioned between the hinge area and the second, free end, the third sheet being separate and spaced from the second sheet along the longitudinal axis of the first sheet; a first pocket positioned between and formed by the first sheet and the second sheet; and a second pocket positioned between and formed by the first sheet and the third sheet.

The foregoing objects are further attained by providing an album page comprising first means for receiving a first article only in a first direction and for prohibiting the first article from moving out of the first means in any direction except in a second direction which is opposite to the first direction; second means for receiving a second article only in a third direction, which is substantially parallel to the first direction and for prohibiting the second article from moving out of the second means in any direction except in a fourth direction which is opposite to the third direction; hinge means for hinging the first and second means to move the second means between a first position, in which the second means is coplanar with the first means and a second position, in which the second means overlaps the first means; and third means coupled to the first means for attaching the first and second means to a binder.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
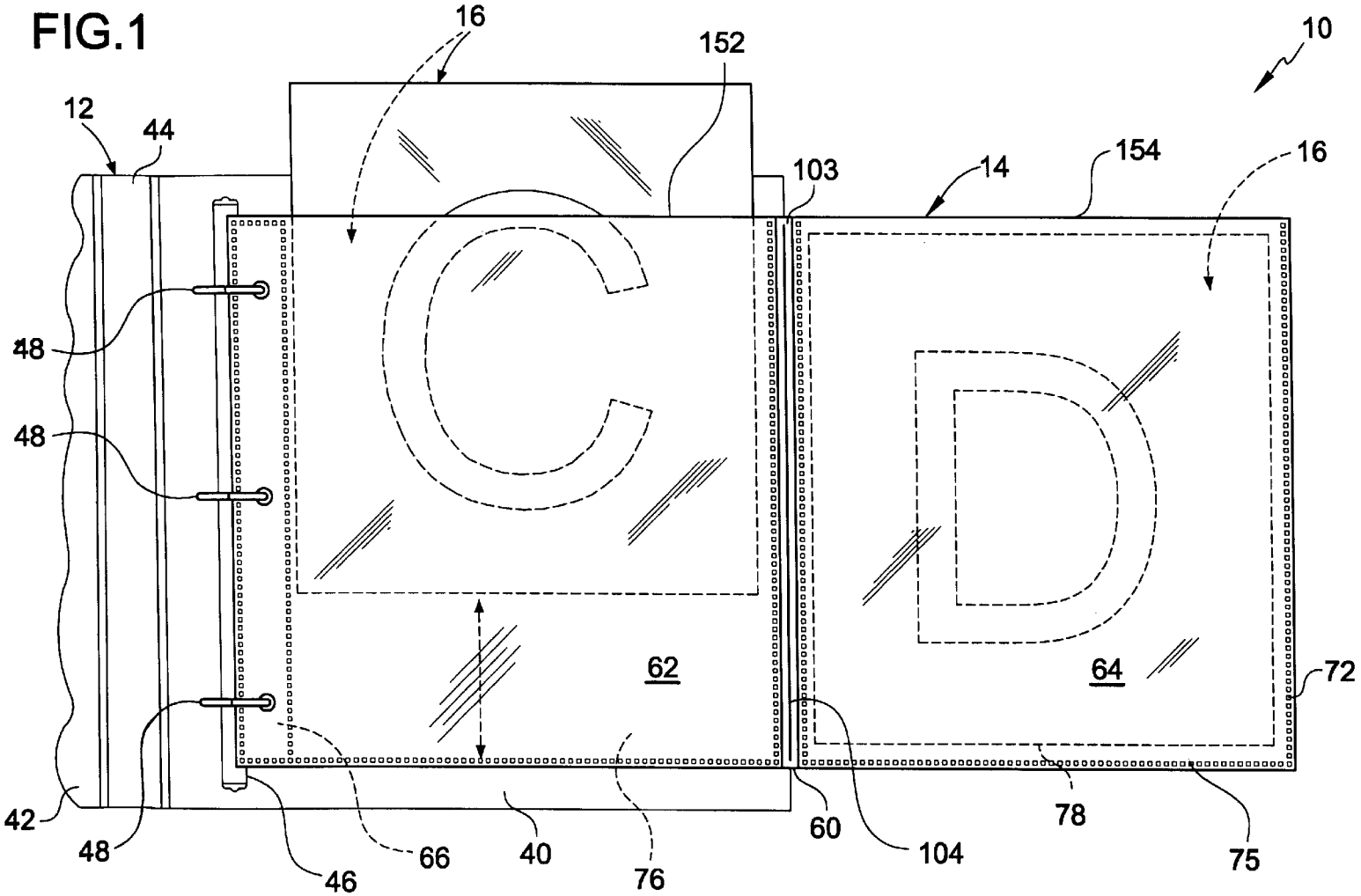
FIG. 1 is a partial front view of a binder assembly in accordance with the present invention, including an album page in accordance with the invention, in the open position and secured within a binder, which is partially shown, and with one article partially inserted into one pocket of the album page and a second article fully inserted into the album page.

FIG. 1 illustrates a binder assembly 10 in accordance with the present invention. Binder assembly 10 includes a binder 12 having an album page 14 attached thereto. Album page 14 receives two articles 16. As seen in FIG. 1, the articles 16 are inserted into album page 14 and viewed through album page 14. FIG. 1 illustrates binder assembly 10 and album page 14 in the open position, which provides a panoramic display of articles 16 when they are inserted into album page 14.

Binder 12 includes a front 40, a back 42, and a folding portion 44 positioned between front 40 and back 42. Folding portion 44 has a locking assembly 46 having three rings 48, which extend through album page 14 to secure album page 14 to binder 12. Binder 12 is a typical three-ring binder as known in the art and therefore will not be described in great detail herein. It should be understood that binder 12 is illustrated as a three-ring binder for purposes of example only and that binder 12 can take many forms in addition to the three-ring binder described. Of course, binders other than three-ring binders could connect with album pages in ways different than disclosed herein. If such is the case, album page 14 can be adapted to have the appropriate attaching mechanism needed to mate with and attach to binders using mechanisms other than rings.

Album page 14 has a main sheet 60, an inner sheet 62, an outer sheet 64, a reinforcing strip 66, vertical heat seals 68, 69, 70, 71 and 72, horizontal heat seals 74 and 75, an inner pocket 76, an outer pocket 78, and a reinforcing strip pocket 80.

Main sheet 60 is a generally planar sheet of material having an inner portion 100, an outer portion 102, a fold line 104 positioned between the inner and outer portions 100 and 102, an attaching portion 106 having ring holes 108, and a top edge 110. Inner sheet 62 has a main portion 120, an attaching portion 122, and a top edge 124. Outer sheet 64 has a main portion 140 and a top edge 142.

Main sheet 60, inner sheet 62, and outer sheet 64 are preferably made of substantially identical material. Preferably, each sheet 60, 62 and 64 is made of a relatively thin and flexible transparent, plastic material as is known in the art for making transparent album pages, or transparent page protectors. Preferably sheets 60, 62 and 64 are of archival quality and made from an acid-free polypropylene. If desired, sheets 60, 62 and 64 can each be formed of different materials or two sheets can be formed from a different material than the third. Sheets 60, 62 and 64 are preferably transparent but can be translucent or opaque and can be formed of various materials, including paper materials. Although three sheets 60, 62 and 64 are preferably used, any number of sheets could be used if desired.

Figure 4:
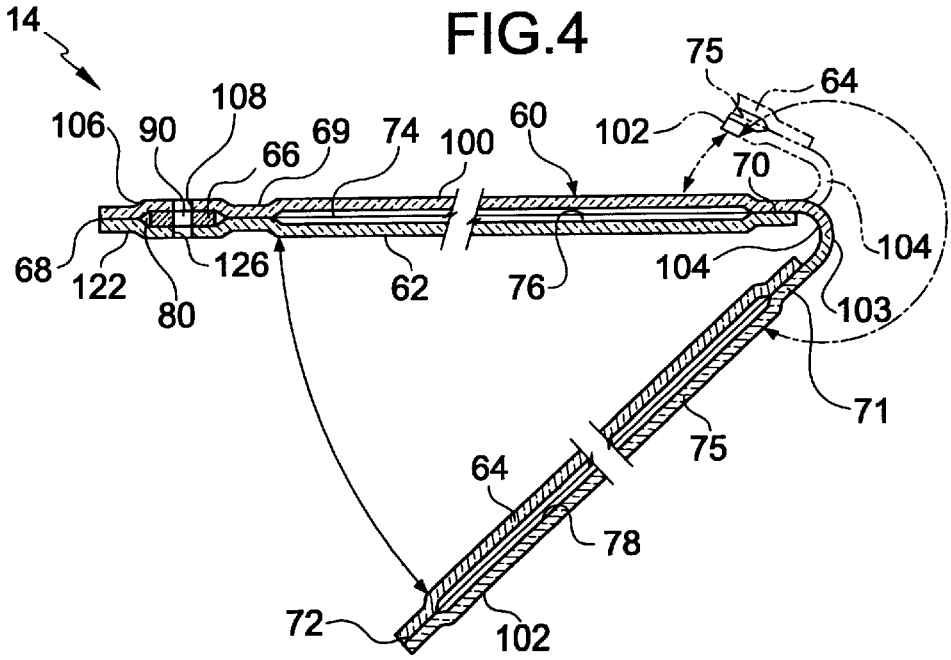
FIG. 4 is a cross-sectional view of the album page in accordance with the present invention taken along line 4—4 of FIG. 3.
Figure 6:
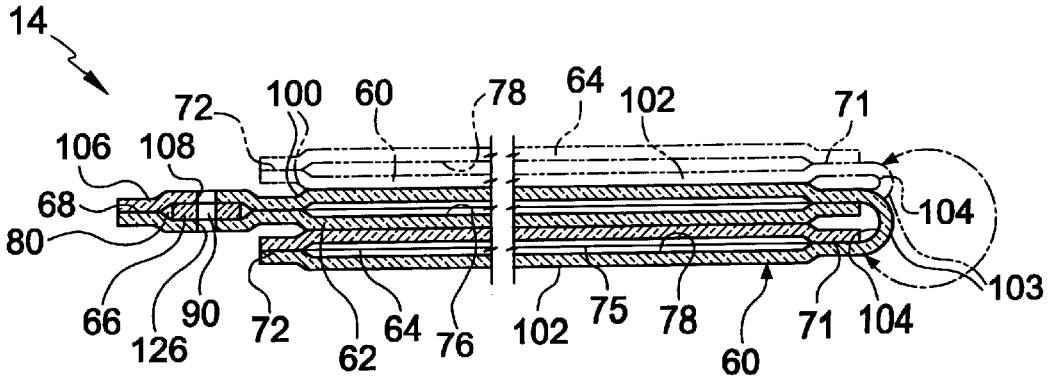
FIG. 6 is a cross-sectional view of the album page in accordance with the present invention taken along line 6—6 of FIG. 5.

As seen in FIGS. 4 and 6, main sheet 60 preferably extends the entire length of album page 14, with inner sheet 62 overlaid on top of main sheet 60 on one side of main sheet 60 and with outer sheet 64 overlaid on top of the other end of main sheet 60. Therefore, as seen in FIG. 2, whereas main sheet 60 extends the entire length of album page 14, inner sheet 62 is attached to the left-hand side of main sheet 60 and outer sheet 64 is attached to the right-hand side of main sheet 60.

Preferably, inner and outer sheets 62 and 64 are spaced from one another on main sheet 60 at the location of fold line 104. Inner and outer 62 and 64 are preferably similarly shaped along three sides with main sheet 60 so that three edges of inner sheet 62 and of outer sheet 64 are substantially flush with three edges of main sheet 60. Inner and outer sheet 62 and 64 are attached to main sheet 60 by heat sealing, as is known in the art.

Figure 2:
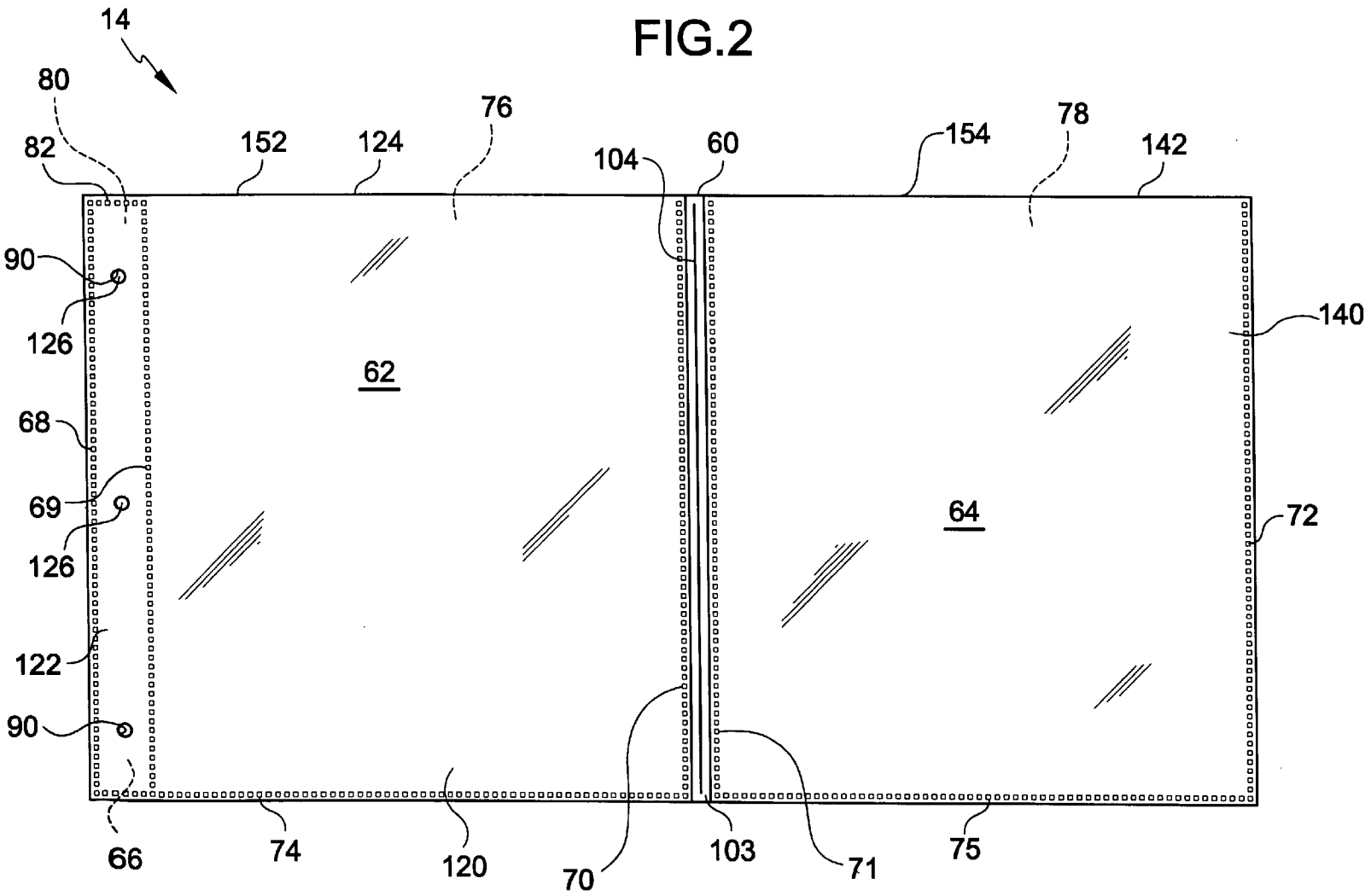
FIG. 2 is a front view of the album page in accordance with the present invention in the open, panoramic display position.
Figure 3:
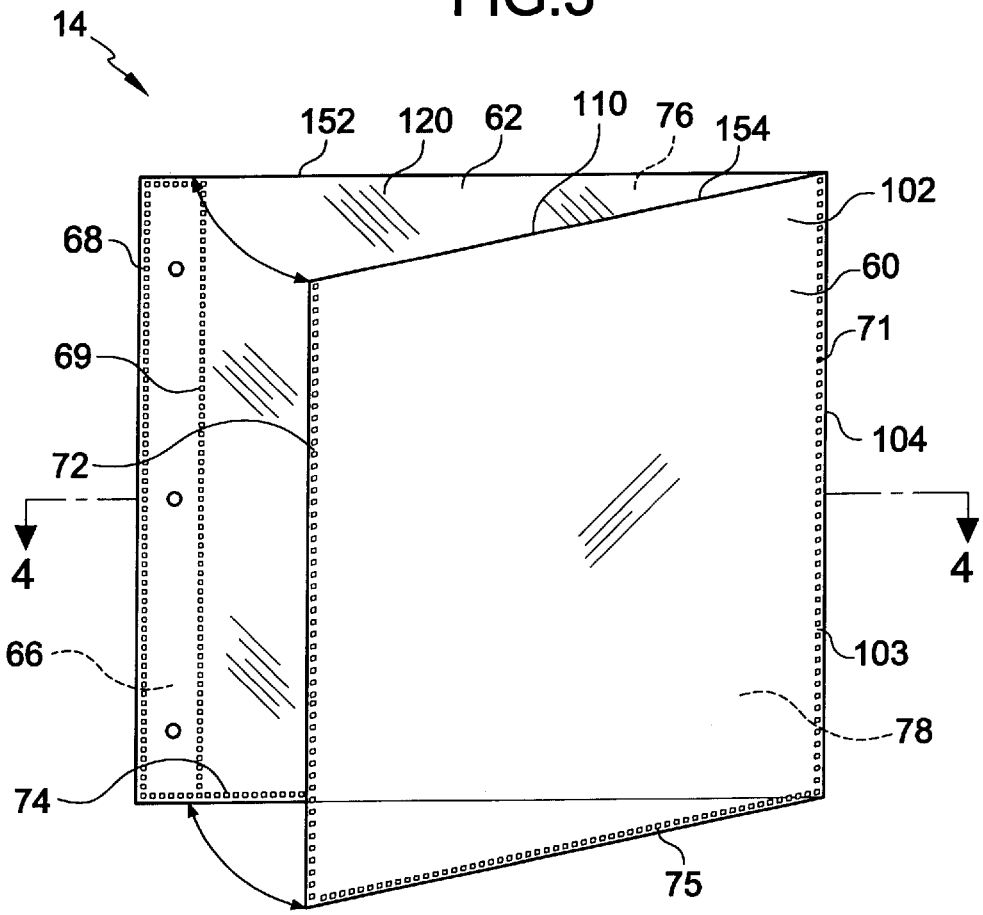
FIG. 3 is a front, top, side perspective view of the album page in accordance with the present invention folded in a position between the closed position and the open position.

As seen in FIG. 2, inner sheet 62 is attached to main sheet 60 by vertical heat seals 68, 69 and 70 and by horizontal heat seal 74 and top heat seal 82. The outer sheet 64 is attached to main sheet 60 by vertical heat seals 71 and 72 and by horizontal heat seal 75. The heat seals 68–72, 74 and 75 not only attach inner and outer sheet 62 and 64 to main sheet 60, but also form inner and outer pockets 76 and 78 and reinforcing strip pocket 80.

Vertical heat seals 68 and 69 extend the entire height of main sheet 60 and inner sheet 62 and are located in a spaced relation to form reinforcing strip pocket 80. As generally known in the art, reinforcing strip 66 is positioned within reinforcing strip pocket 80 and itself extends along the entire height of album page 14 to reinforce the attaching areas of main sheet 60 and inner sheet 62. That is, reinforcing strip 66 reinforces the ring holes 108 in main sheet 60 and ring holes 126 in inner sheet 62, as is generally known in the art. Reinforcing strip 66 is secured within reinforcing strip pocket on its sides by vertical heat seals 68 and 69 and at its top by top heat seal 82 and its bottom by horizontal heat seal 74.

Reinforcing strip 66 has ring holes 90, which align with ring holes 108 and 126. Ring holes 108 and 126 extend completely through main sheet 60 and inner sheet 62, respectfully, and are spaced as is known in the art to correspond with rings 48. When rings 48 are opened, album pages attached to binder 12 by inserting each ring 48 through a pair of ring holes 108 and 126.

Inner pocket 76 is formed by vertical heat seals 69 and 70 and by horizontal heat seals 74. Access into inner pocket 76 is gained through an access opening 152, which is permitted since top edge 110 of main sheet 60 and top edge 124 of inner sheet 62 are not attached and are free to be separated from each other for insertion of article 16 into pocket 76. Outer pocket 78 is formed by vertical heat seals 71 and 72 and by horizontal heat seal 75. Access to outer pocket 78 is possible through access opening 154, which is positioned at top edge 110 of main sheet 60 and top edge 142 of outer sheet 64. Top edges 110 and 142 are not attached and are capable of being separated to allow for insertion of article 16 into pocket 78.

Inner and outer pockets 76 and 78 can be of any size desired or deemed necessary by the user to hold various sized articles. For example, if articles 16 are 8½ inch by 11 inch sheets of material, and if inner and outer pockets 76 and 78 are intended to receive the 8½ inch by 11 inch sheets, inner and outer pockets 76 and 78 are slightly larger than 8½ inch by 11 inch to easily and completely receive the 8 ½ inch by 11 inch articles 16, when article 16 is completely received within one of inner pockets 76 and 78. Preferably, each pocket 76 and 78 can receive two articles 16, such as two 8½ inch by 11 inch sheets of material. Thus, each album page 14 can then display four articles 16, one article 16 through each of inner and outer sheets 62 and 64, and an article 16 opposite each one of those articles 18, through the rear of main sheet 60.

As seen in FIG. 1, an article 16 has been completely inserted into outer pocket 78 and partially inserted into pocket 76. Article 16 can be any article that is sufficiently sized to fit within either inner pocket 16 or outer pocket 78. For example, article 16 can include photographs or drawings, or the like.

The inner pocket 76 and outer pocket 78 can be folded relative to one another along a fold line 104. Fold line 104 can be a distinct fold line formed in main sheet 60 to aid in folding by creasing main sheet 60 or can be merely an area without any marking or creasing, at which the inner and outer portions 100 and 102 of main sheet 60 can be folded. Since inner and outer sheet 62 and 64 are spaced on opposite sides of fold line 104, the area of main sheet 60 between inner and outer sheet 62 and 64 is only one sheet thick and is, thus, the thinnest part of album page 14. The area of main sheet 60 between inner and outer sheets 62 and 64 is generally a folding area.

Figure 5:
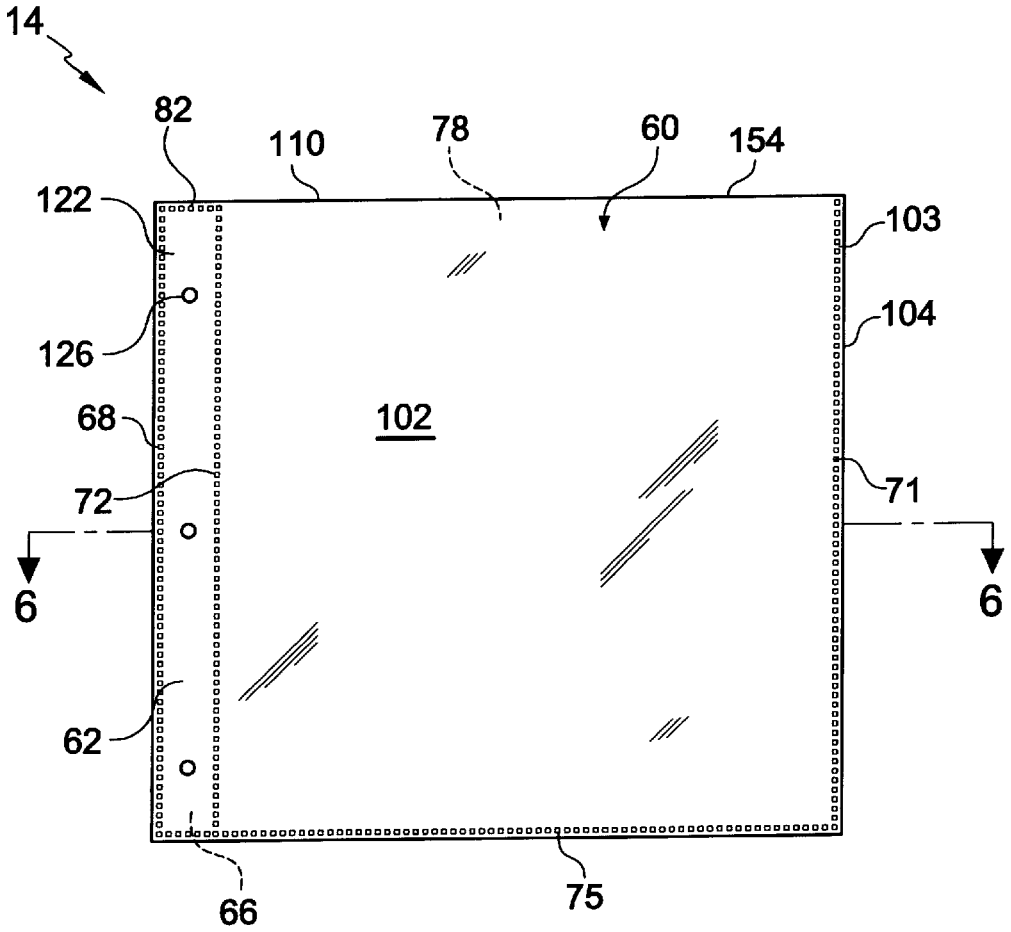
FIG. 5 is a front view of the album page in accordance with the present invention folded in the closed position.

As seen in FIGS. 2–6, folding line 104 enables album page 14 to be folded between an open position as shown in FIG. 2 and a closed position as shown in FIG. 5. The folding of album page 14 between the two positions is preferably accomplished in one of two ways. First, as illustrated in solid lines in FIGS. 3–6, the outer portion 102 of main sheet 60 and the outer sheet 64 can be folded along folding line 104 until inner sheet 62 contacts outer sheet 64 as seen in FIG. 6. In this position, album page 14 is in the closed position and is now sized to fit completely within binder 12. Binder 12 can then be closed while album page 14 is completely protected by the front 40 and back 48 of binder 12, as is generally intended and desired in a binder, such as binder 12. But when it is desired to view articles 16 when they are inserted in inner and outer pockets 76 and 78, binder 12 can be opened and the outer sheet 64 and outer portion 102 of main sheet 60 can be folded again along folding line 104 back to the open position as illustrated in FIGS. 1 and 2.

The second way of folding the album page 14 is illustrated in dotted lines in FIGS. 4 and 6. Since folding area, or hinge 103 is formed of only one sheet of material, it is sufficiently flexible to be folded either as described above and as shown in solid lines in FIGS. 4 and 6 or folded in an opposite manner as illustrated in dotted lines in FIGS. 4 and 6. That is, outer sheet 64 and outer portion 102 of main sheet 60 can be folded about folding line 104 such that outer sheet 64 contacts inner sheet 62 as seen in dotted lines in FIG. 6. Thus, hinge 103 permits outer pocket 78 to pivot approximately 360 degrees between the two positions, i.e., the solid and dashed lines, illustrated in FIG. 6.

Figure 8:
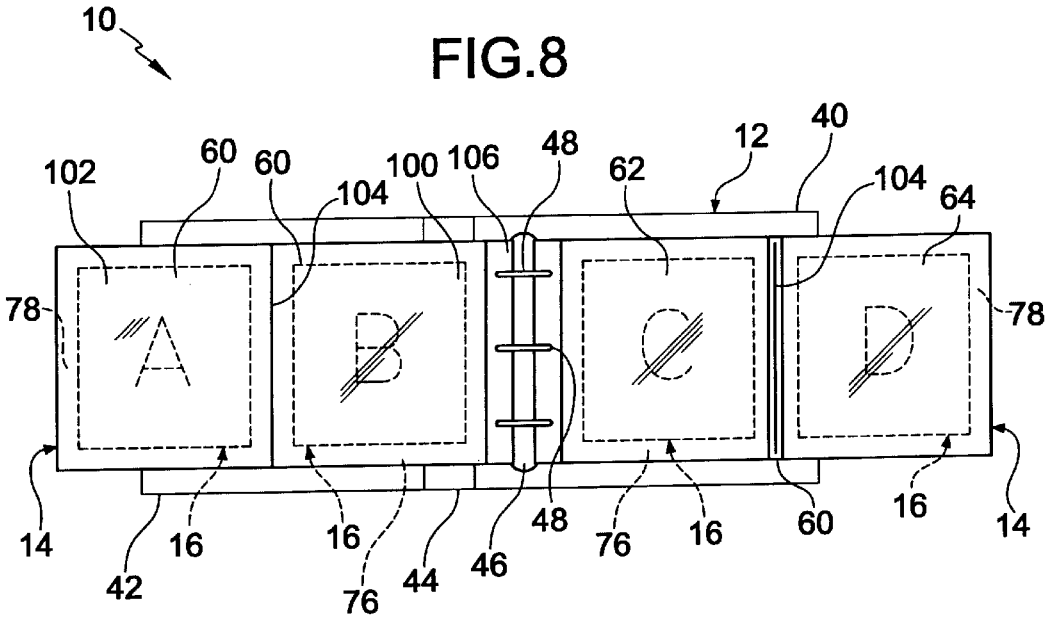
FIG. 8 is a front view of the binder assembly illustrated in FIG. 7 with two album pages, both in the open position.

As seen in FIG. 8, if multiple album pages 14 are used in a single binder 12 adjacent album pages 14 can be used to display four articles 16 simultaneously. That is, a first album page 14 can be opened as illustrated in FIG. 1 and the right side of FIG. 8, thus displaying two articles 16 simultaneously. Additionally, a second album page 14 can be positioned within binder 12 and can extend adjacent the front 40 of binder 12, or to the left side of FIG. 8, so that when both album pages 14 are in the open position, a total of four articles 16 can be displayed simultaneously. Therefore, not only can a panoramic display be achieved through the use of two articles 16 being inserted into inner and outer pockets 76 and 78 of a first album page 14, but an even greater panoramic display can be achieved by opening an additional album page 14 adjacent to the first album page 14.

Figure 7:
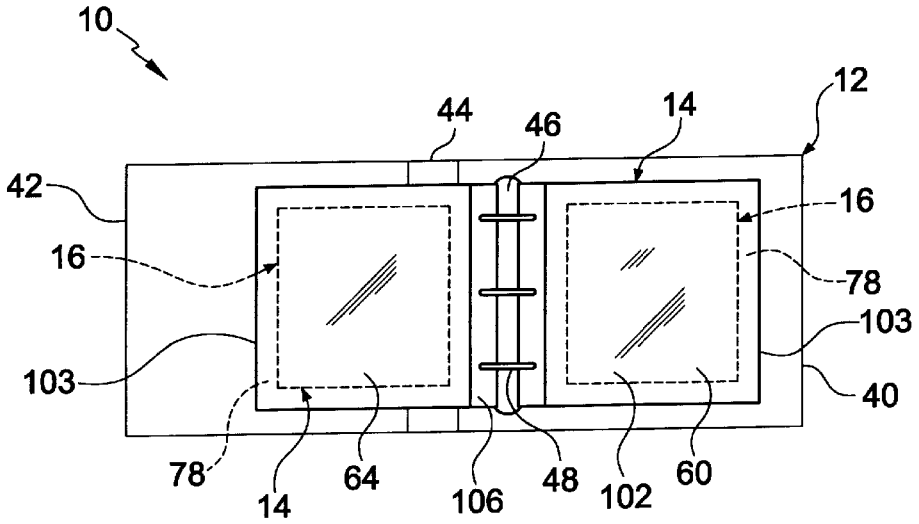
FIG. 7 is a front view of a binder assembly in accordance with the present invention with two album pages in accordance with the present invention, both in the closed position and secured to a binder in the open position.

When using two album pages 14 simultaneously to display four articles 16 in the open positions, it may be desirable to fold both pages 14 in towards each other as seen in FIG. 7. Thus, the album page 14 illustrated in FIG. 1, or the right side of FIGS. 7 and 8, can be folded as illustrated in the solid lines of FIG. 6, while the adjacent album page 14, illustrated on the left side of FIGS. 7 and 8, can be folded as illustrated in the dotted lines in FIG. 6. This enables both outer pockets 78 to be opened away from each other simultaneously. This gives the user the ability to open a binder 12 viewing two articles 16 of two-sheet panoramic display as in FIG. 7, and then simultaneously folding left and right album pages 14 such that outer pockets 78 fold away from each other to simultaneously produce a different, full, four-sheet panoramic display.

Album page 14 is illustrated herein as having two pockets 76, 78 folding relative to each other. Alternatively, pockets 76 and/or 78 can be replaced by multiple pockets on each inner and outer sheet 62 and 64. Also, any number of sheets 62, 64 can be combined by numerous folding lines to produce an album page being capable of folding numerous times, having numerous pockets, to create even larger panoramic displays. For example, album page 14 can have four pockets like 76 and 78 so that each one can receive an article 16 to create a four-sheet panoramic display from one album page 14 or an eight-sheet panoramic display from a two album pages used similar to those shown in FIG. 8.

While advantageous embodiments have been chosen to illustrate the invention, it will be understood by those skilled in the art from this disclosure that various changes and modifications can be made therein without departing from the scope of the invention as defined in the appended claims.

What is claimed is:

1. An album page comprising:

a first member having a first perimeter and a first pocket within said first perimeter, said first pocket being formed by first and second sheets, said first and second sheets having substantially the same area as each other and being coupled together along a first closed portion of said first perimeter and said first and second sheets being uncoupled along a first open portion of said first perimeter, said first open portion allowing insertion of an article into said first pocket in a first direction, and said first closed portion prohibiting insertion of the article in said first pocket in any direction transverse to said first direction or opposite to said first direction;

a second member having a second perimeter and a second pocket within said second perimeter, said second pocket being formed by third and fourth sheets and having at least one of a width substantially equal to a width of said first pocket and a length substantially equal to a length of said first pocket, said third and fourth sheets having substantially the same area as each other and being coupled together along a second closed portion of said second perimeter and said third and fourth sheets being uncoupled along a second open portion of said second perimeter, said second open portion allowing insertion of an article into said second pocket in a second direction which is substantially parallel to said first direction, and said second closed portion prohibiting insertion of the article in said second pocket in any direction transverse to said second direction or opposite to said second direction;

a hinge coupled to both said first and second members and positioned between said first and second members, permitting said album page to be folded so that said first and second members can overlap each other; and a binder attaching element coupled to said first member and having at least one fastening portion.

2. An album page according to claim 1, wherein said first, second, third, and fourth sheets are formed from transparent, plastic material.

3. An album page according to claim 1, wherein said first pocket and said second pocket are substantially identical.

4. An album page according to claim 3, wherein said first and second pockets are formed as first and second substantially rectangular pockets, with said first open portion forming one side of said first pocket and said first closed portion forming the other three sides of said first pocket.

5. An album page according to claim 3, wherein said hinge extends along the entire length of both said first and second members.

6. An album page according to claim 1, wherein said first sheet, said third sheet, and said hinge are integrally formed as one sheet of unitary material.

7. An album page according to claim 1, wherein said first and second open portions are substantially collinear.

8. An album page comprising:

a first sheet having a longitudinal axis, a hinge area extending substantially perpendicularly to said longitudinal axis, a binder attaching element extending substantially perpendicularly to said longitudinal axis at a first end of said sheet, and a second, free end extending substantially perpendicularly to said longitudinal axis;

a second sheet coupled to and overlapping said first sheet and positioned between said binder attaching element and said hinge area;

a third sheet coupled to and overlapping said first sheet and positioned between said hinge area and said second, free end, said third sheet being separate and spaced from said second sheet along said longitudinal axis of said first sheet;

a first pocket positioned between and formed by said first sheet and said second sheet such that a first edge of said first sheet and a second edge of said second sheet form a first open portion in said first pocket; and a second pocket positioned between and formed by said first sheet and said third sheet such that said first edge of said first sheet and a first edge of said second sheet form a third open portion in said second pocket.

9. An album page according to claim 8, wherein said first, second, and third sheets are formed from transparent, plastic material.

10. An album page according to claim 8, wherein said first pocket and said second pocket are substantially identical.

11. An album page according to claim 10, wherein said first and second pockets are formed as first and second substantially rectangular pockets with one open side and three closed sides.

12. An album page according to claim 8, wherein said first sheet is integrally formed as a single sheet of unitary material.

13. An album page according to claim 8, wherein said first and second pockets are closed except for said first and second open portions, respectively, and said first and second open portions being substantially collinear and substantially parallel to said longitudinal axis of said first sheet.

14. An album page according to claim 8, wherein said second pocket is movable between a first position, in which said third sheet is coplanar with said second sheet and a second position, in which said third sheet overlaps said second sheet.

15. An album page according to claim 14, wherein said second pocket, in said second position, completely overlaps said first pocket.

16. An album page comprising:

first means for receiving a first article only in a first direction and for prohibiting the first article from moving out of said first means in any direction except in a second direction which is opposite to said first direction, said first means having a first width and a first length;

second means for receiving a second article only in a third direction, which is substantially parallel to said first direction and for prohibiting the second article from moving out of said second means in any direction except in a fourth direction which is opposite to said third direction, said second means having a second width and a second length, said second means having a second width and a second length such that at least one of the following conditions exists: said first and second widths are substantially equal, and said first and second lengths are substantially equal;

hinge means for hinging said first and second means to move said second means between a first position, in which said second means is coplanar with said first means and a second position, in which said second means overlaps said first means, said hinge means extending in a fifth direction substantially parallel to said first, second, third, and fourth directions; and third means coupled to said first means for attaching said first and second means to a binder.

17. An album page according to claim 16, wherein said first and second means are formed by sheets of transparent, plastic material.

18. An album page according to claim 17, wherein said first and second means form first and second pockets, respectively, and said first and second pockets are substantially identical.

19. An album page according to claim 16, wherein said first means has a first surface and a second, opposite surface, and said hinge means permits said second means to pivot approximately 360 degrees between contacting said first surface and contacting said second, opposite surface.

20. A binder assembly, comprising:

a binder;

a first album page coupled to said binder and having a first member having a first perimeter and a first pocket within said first perimeter, said first pocket being formed by first and second sheets and receiving a first article, said first and second sheets having substantially the same area as each other and being coupled together along a first closed portion of said first perimeter and said first and second sheets being uncoupled along a first open portion of said first perimeter, said first open portion allowing insertion of an article into said first pocket in a first direction, and said first closed portion prohibiting insertion of the article in said first pocket in any direction transverse to said first direction or opposite to said first direction, a second member having a second perimeter and a second pocket within said second perimeter and receiving a second article, said second pocket being formed by third and fourth sheets and having at least one of a width substantially equal to a width of said first pocket and a length substantially equal to a length of said first pocket, said third and fourth sheets having substantially the same area as each other and being coupled together along a second closed portion of said second perimeter and said third and fourth sheets being uncoupled along a second open portion of said second perimeter, said second open portion allowing insertion of an article into said second pocket in a second direction which is substantially parallel to said first direction, and said second closed portion prohibiting insertion of the article in said second pocket in any direction transverse to said second direction or opposite to said second direction, a hinge coupled to both said first and second members and positioned between said first and second members, permitting said album page to be folded so that said first and second members can overlap each other, and a binder attaching element coupled to said first member and having at least one fastening portion; and a second album page coupled to said binder and having a first member having a first perimeter and a first pocket within said first perimeter, said first pocket being formed by first and second sheets and receiving a third article, said first and second sheets being coupled together along a first closed portion of said first perimeter and said first and second sheets being uncoupled along a first open portion of said first perimeter, said first open portion allowing insertion of an article into said first pocket in a first direction, and said first closed portion prohibiting insertion of the article in said first pocket in any direction transverse to said first direction or opposite to said first direction, a second member having a second perimeter and a second pocket within said second perimeter and receiving a fourth article, said second pocket being formed by third and fourth sheets, said third and fourth sheets being coupled together along a second closed portion of said second perimeter and said third and fourth sheets being uncoupled along a second open portion of said second perimeter, said second open portion allowing insertion of an article into said second pocket in a second direction which is substantially parallel to said first direction, and said second closed portion prohibiting insertion of the article in said second pocket in any direction transverse to said second direction or opposite to said second direction, a hinge coupled to both said first and second members and positioned between said first and second members permitting said album page to be folded so that said first and second members can overlap each other, and a binder attaching element coupled to said first member and having at least one fastening portion, wherein said first, second, third, and fourth articles can be simultaneously viewed.

21. An album page according to claim 1, wherein each of said first and second open portions, respectively, are substantially perpendicular to said hinge.

22. An album page according to claim 1, wherein said first, second, third, and fourth sheets have substantially the same area as each other.

23. An album page according to claim 1, wherein said width and length of said first pocket are substantially equal to said width and length, respectively, of said first pocket.

24. A binder assembly according to claim 20, wherein said first and second sheets of said second album page have substantially the same area as each other;

said third and fourth sheets of said second album page have substantially the same area as each other; and said second pocket of said second album page has at least one of a width substantially equal to a width of said first pocket of said second album page and a length substantially equal to a length of said first pocket of said second album page.

25. A binder assembly according to claim 20, wherein said hinge of said first album page is substantially perpendicular to each of said first and second open portions, respectively, of said first and second pockets of said first album page.

26. A binder assembly according to claim 25, wherein said hinge of said second album page is substantially perpendicular to each of said first and second open portions, respectively, of said first and second pockets of said second album page.

* * * * *